United States Patent [19]

Wilde et al.

[11] 4,378,893

[45] Apr. 5, 1983

[54] COMPOSITE CLOSURE

[75] Inventors: Sheldon L. Wilde; Thomas J. McCandless, both of Crawfordsville; Robert M. Saunders, Ladoga, all of Ind.

[73] Assignee: H-C Industries, Inc., Crawfordsville, Ind.

[21] Appl. No.: 270,241

[22] Filed: Jun. 4, 1981

Related U.S. Application Data

[63] Continuation-in-part of Ser. No. 77,566, Sep. 21, 1979, abandoned.

[51] Int. Cl.[3] ..... B65D 53/04

[52] U.S. Cl. ..... 215/246; 215/252; 215/343; 215/350

[58] Field of Search ..... 215/350, 343, 246, 252

[56] References Cited

U.S. PATENT DOCUMENTS

| | | | |
|---|---|---|---|
| 2,068,389 | 1/1937 | Smith | 215/350 |
| 2,072,536 | 3/1937 | Trickey et al. . | |
| 2,372,177 | 3/1945 | Conner | 150/0.5 UX |
| 2,607,957 | 8/1952 | Danielson et al. . | |
| 2,823,422 | 2/1958 | Schnider . | |
| 2,840,858 | 7/1958 | Rainer et al. . | |
| 3,189,209 | 6/1965 | Owens . | |
| 3,325,576 | 6/1967 | Kessler . | |
| 3,462,034 | 8/1969 | Friedberg | 215/350 X |
| 3,536,224 | 10/1970 | Green . | |
| 3,557,030 | 1/1971 | Simons . | |
| 3,612,325 | 10/1971 | Williams . | |
| 3,673,761 | 7/1972 | Leitz . | |
| 3,788,510 | 1/1974 | Collins | 215/350 X |
| 3,812,991 | 5/1974 | Wurl | 215/252 |
| 3,828,963 | 8/1974 | Moller | 215/252 X |
| 3,844,861 | 10/1974 | Irish | 215/246 X |
| 3,861,551 | 1/1975 | Hannon | 215/252 |
| 4,033,472 | 7/1977 | Aichinger | 215/256 |
| 4,088,730 | 5/1978 | Wilde . | |
| 4,130,213 | 12/1978 | Wszolek | 215/349 |
| 4,140,451 | 2/1979 | Herdzina . | |
| 4,156,490 | 5/1979 | Peraboni | 215/252 |
| 4,206,851 | 6/1980 | Ostrowsky | 215/246 |

FOREIGN PATENT DOCUMENTS

| | | | |
|---|---|---|---|
| 2825886 | 1/1979 | Fed. Rep. of Germany . | |
| 851275 | 10/1939 | France . | |
| 464721 | 12/1968 | Switzerland . | |
| 283447 | 1/1928 | United Kingdom . | |
| 1384370 | 2/1975 | United Kingdom | 215/246 |
| 1577663 | 10/1980 | United Kingdom . | |

*Primary Examiner*—Donald F. Norton

*Attorney, Agent, or Firm*—Dressler, Goldsmith, Shore, Sutker & Milnamow

[57] ABSTRACT

A composite closure having a plastic cap with a specially configured arrangement for retention of a plastic liner. In one embodiment, integral pedestals are provided each have an overhang, such as a mushroom-shaped head, to provide a mechanical interlock with the liner. In other embodiments, pedestals are provided each having a fusible heat concentration zone that is fused to the liner as the liner is compression molded and heated in the cap. In one embodiment, the fusible pedestals are each cylindrical. In another embodiment, the fusible pedestals are each in the shape of a pyramid.

74 Claims, 10 Drawing Figures

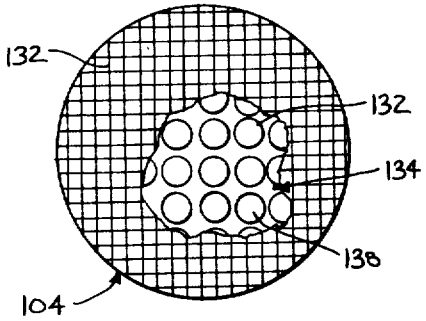
fig. 2
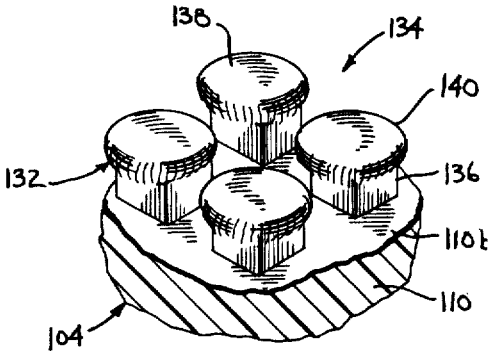
fig. 3
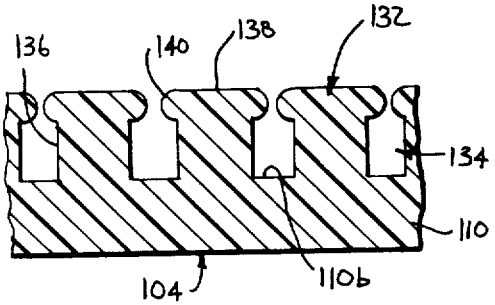
fig. 4
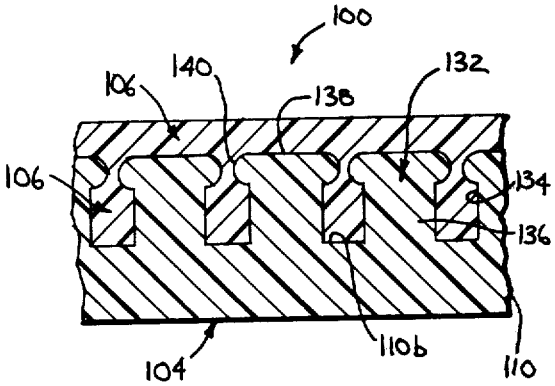
fig. 5
fig. 1
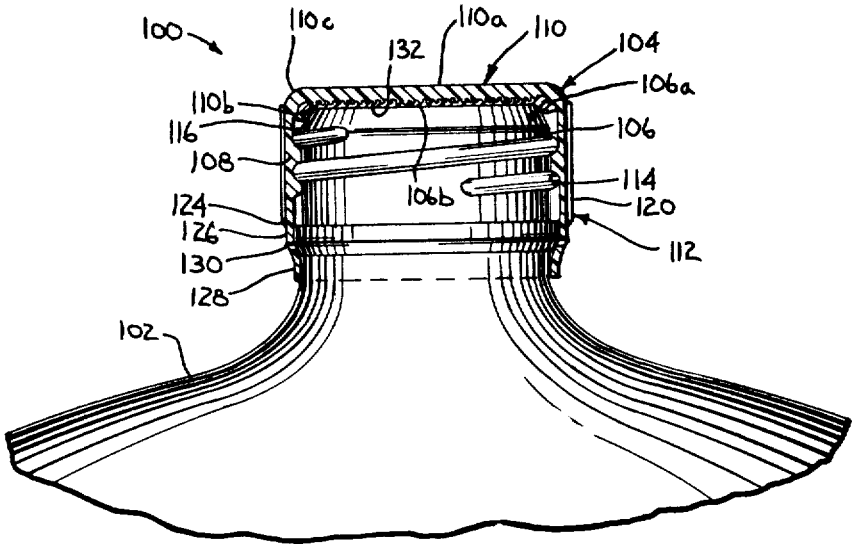

fig. 6
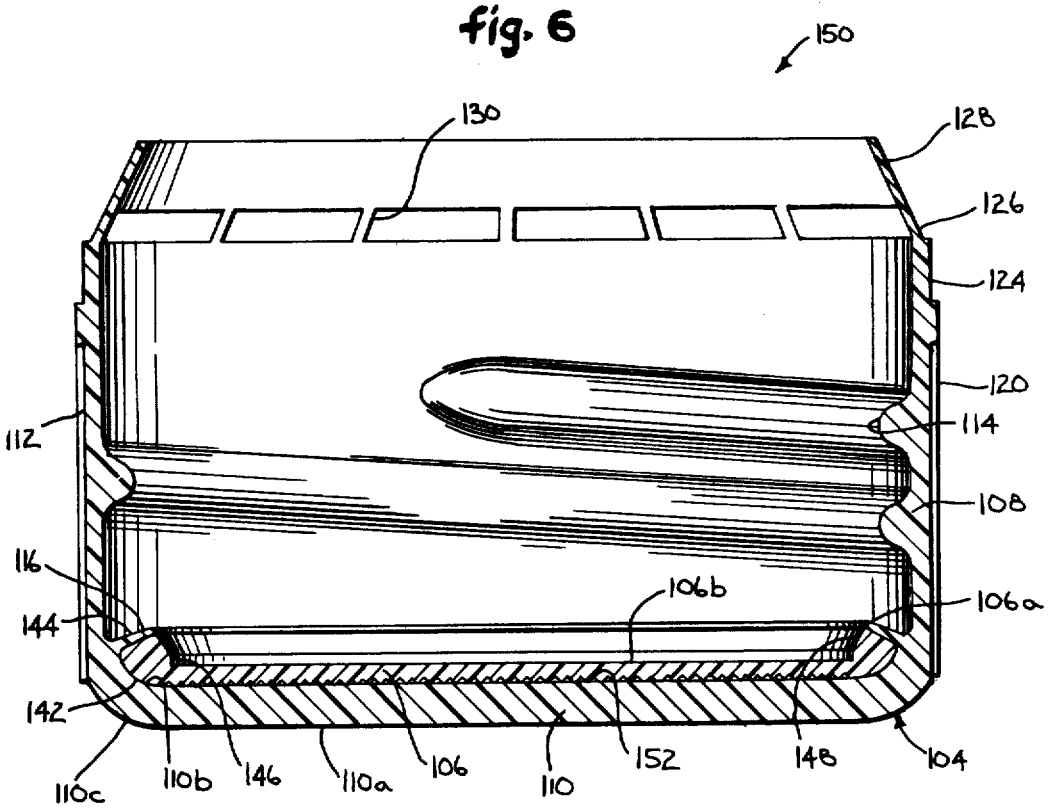
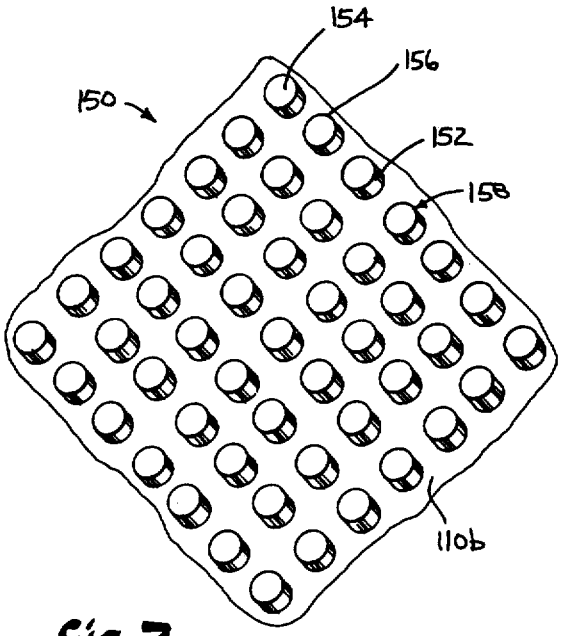
fig.7
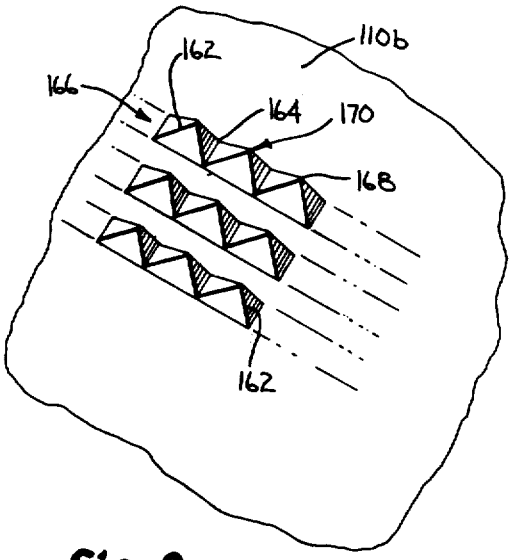
fig.8

FIG. 9
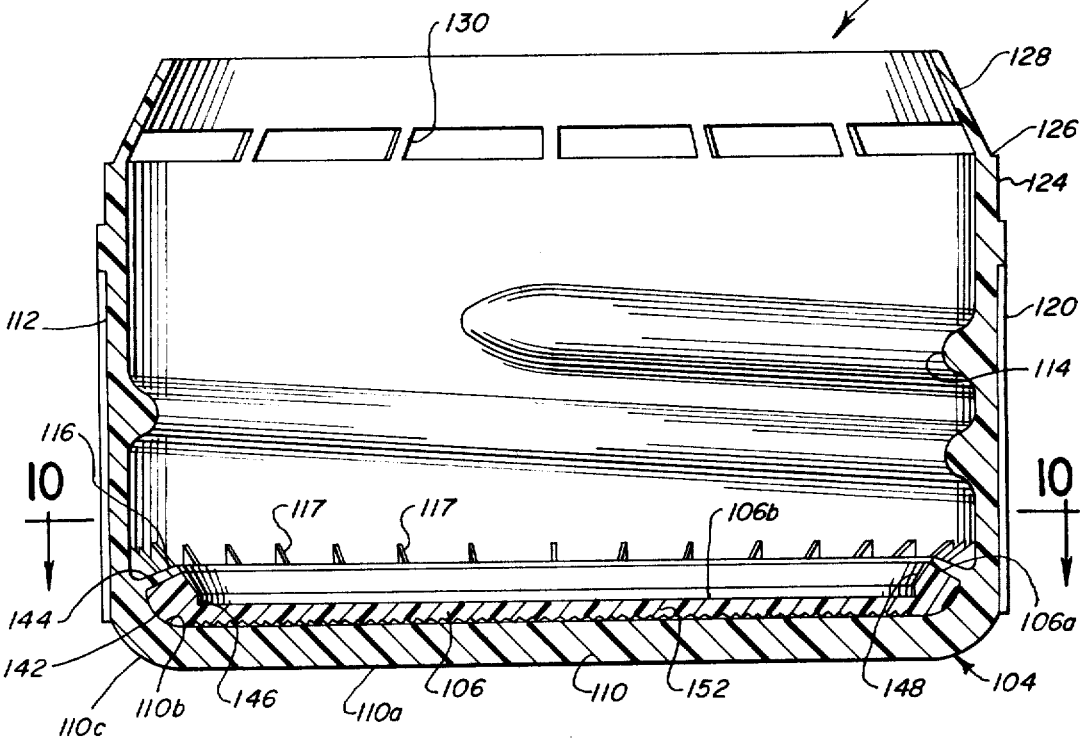
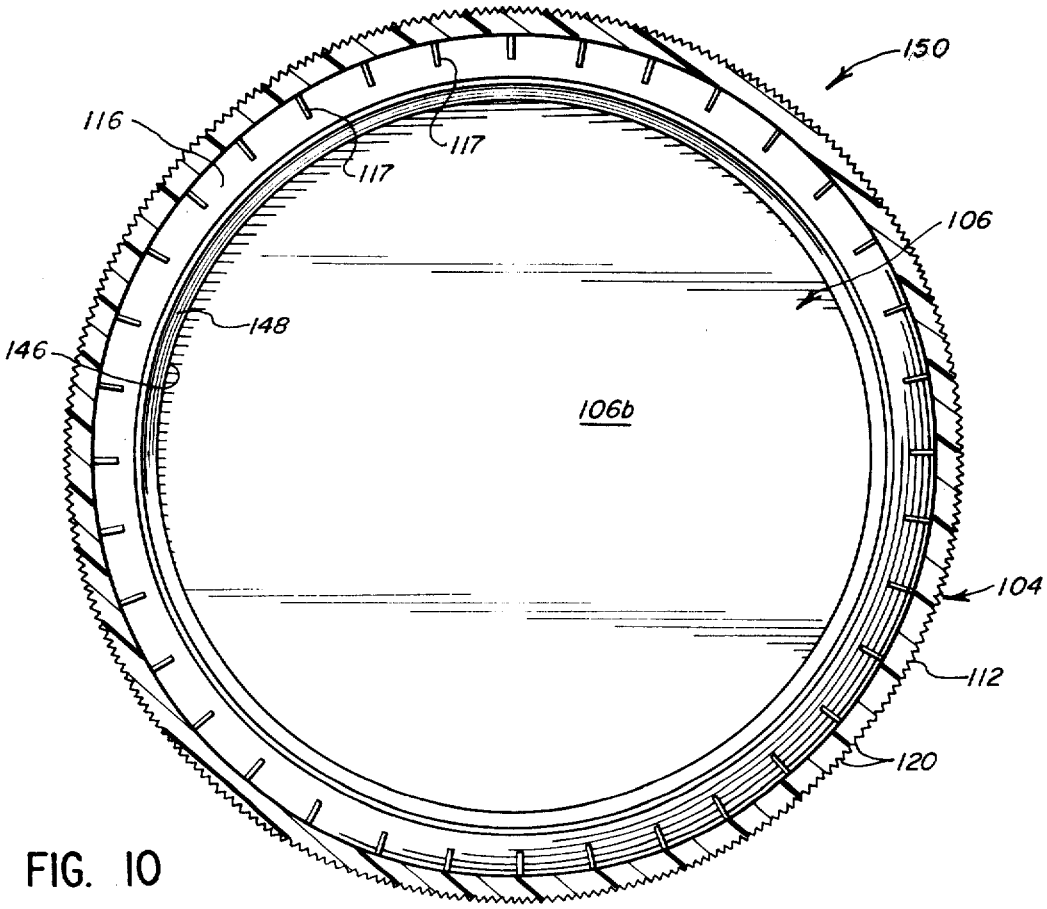
FIG. 10

COMPOSITE CLOSURE

CROSS-REFERENCE TO RELATED APPLICATION

This application is a continuation-in-part of application Ser. No. 077,566, filed Sept. 21, 1979, now abandoned.

BACKGROUND OF THE INVENTION

This invention relates to closures, and more particularly, to a composite plastic closure for bottles.

Over the years metal crowns have been lined with various materials such as cork, rubber, thermosetting plastic and thermoplastic. Representative of the many crowns lined with such material are those shown in U.S. Pat. Nos. 1,486,937, 2,548,305, 2,654,913, 2,684,774, 2,688,776, 2,696,318, 2,823,422, 2,834,498, 2,840,858, 2,952,035, 3,183,144, 3,278,985 and 3,300,072. These prior art crowns have met with varying degrees of success.

Recently, the advantages of plastic crowns and closures have been recognized. The physical characteristics and nature of plastics, however, such as their melting and plastic deformation temperatures, and their resiliency, impact and compression strengths, at molding and refrigeration temperatures, present different structural problems in molding plastic closures than in metal closures.

In prior art plastic closures, for example, the wall thickness is confined to a limited range, i.e., the wall must be thin enough to permit axial removal and deflection of the threaded skirt of the closure from the plunger, but thick enough to support the necessary thread height and profile. The threads of conventional plastic closures are also limited to a certain amount of taper to permit deflection and removal of the threaded skirt from the plunger.

In conventional plastic closures, such as polypropylene closures, the closures have low impact strength and fail a drop test in the refrigeration range of 32–40 degrees F.

It is therefore desirable to provide an improved plastic closure which overcomes most, if not all, of the above disadvantages.

SUMMARY OF THE INVENTION

An improved composite plastic closure for bottles and other containers has a plastic cap with a novel liner retention arrangement that is adapted to provide a secure mechanical or thermal inter-connection with a plastic liner. The preferred embodiment includes an integral liner-retaining annular lip engaging an annular bead portion of the plastic liner, and further includes liner-engaging pedestals which extend from the top wall of the cap in an area bounded by the closure-skirt. Portions of the pedestals are spaced apart from each other to define spaces that receive the plastic liner.

In one embodiment, each of the pedestals has at least one portion that provides an overhang to interlockingly engage the liner. In the preferred form, the overhang is mushroom-shaped.

In other embodiments the pedestal includes fusible pedestals with heat concentration zones that are fused to the liner.

In one embodiment, each of the fusible pedestals is cylindrical with a circular edge that defines part of the heat concentration zone.

In another embodiment, each of the fusible pedestals has an apex that defines part of the heat concentration zone. Preferably, such pedestals are pyramid-shaped.

In order to determine whether the seal between the container and closure has been opened, the closure is formed with a pilfer band that is detachably connected to the skirt, which in the preferred embodiment is biased inwardly of the skirt.

A more detailed explanation of the invention is provided in the following description and appended claims taken in conjunction with the accompanying drawings.

BRIEF DESCRIPTION OF THE DRAWINGS

FIG. 1 is a cross-sectional view of a composite plastic closure in accordance with principles of the present invention, that has been screwed onto a container to provide a fluid tight seal with its finish;

FIG. 2 is a bottom plan view of the underside of the cap of the composite closure with greatly magnified portions broken away for ease of clarity and understanding;

FIG. 3 is a greatly enlarged perspective view of some of the mushroom-shaped pedestals of the closure, with portions of the cap's top wall shown in cross-section;

FIG. 4 is a cross-sectional view of some of the mushroom-shaped pedestals of the cap;

FIG. 5 is a cross-sectional view similar to FIG. 4, but showing the liner in interlocking engagement with the mushroom-shaped pedestals;

FIG. 6 is an enlarged cross-sectional view of another composite plastic closure having schematically shown fusible portions in accordance with principles of the present invention;

FIG. 7 is a greatly magnified perspective view of some of the fusible cylindrical pedestals which may comprise the fusible portions of the composite closure of FIG. 6;

FIG. 8 is a greatly magnified perspective view of some of the fusible pyramid-shaped pedestals of another composite plastic closure in accordance with principles of the present invention;

FIG. 9 is an enlarged cross-sectional view of a modification of the plastic closure shown in FIG. 6; and FIG. 10 is a full cross-sectional view taken along lines 10—10 of FIG. 9.

DETAILED DESCRIPTION OF THE ILLUSTRATIVE EMBODIMENT

Referring to FIG. 1 of the drawings, a composite plastic closure 100 is provided to close and fluidly seal the finish of a threaded bottle 102 or other containers filled with a liquid, such as a carbonated beverage. Composite closure has a resilient plastic cap 104, which is sometimes referred to as a shell or crown, and has a resilient substantially fluid-impervious plastic liner or seal 106. Cap 104 is preferably made of moldable thermoplastic, such as polypropylene or polyethylene. Other materials can also be used. Liner 106 is preferably made of moldable thermoplastic, such as polyvinyl chloride (PVC). Other liner materials, such as ethylene vinyl acetate (EVA) can also be used.

In order to increase the strength of the cap, the cap has spun plastic portions that provide a spiral molecular orientation, i.e., spirally orientated molecules at 108. The spiral orientation gives the cap greater hoop strength and crack resistance than plastic caps formed without spiral orientation. The spun plastic material provides good impact strength and enables the cap to pass a drop test in the refrigeration temperature range of 32–40 degrees F.

In the preferred embodiment, cap 104 is of a one-piece unitary construction and is made of a polypropylene homopolymer. All the parts and components of the plastic cap 104 are integrally connected to each other. The cap 104 has a top wall disc-shaped portion or surface 110 that is sometimes referred to as the "top," and an annular peripheral skirt 112 depending from the top 110. Top 110 has a generally flat outer surface 110*a* and an inner surface that provides an underside 110*b*. The circular edge or corner 110*c* formed by the intersection of the top and the skirt is rounded or chamfered.

As shown in FIG. 6 skirt 112 has internal threads 14 and an integral, inwardly extending, liner-retaining annular lip 116 that provides a retainer to retain and confine the annular bead portion 106*a* of liner 106 and serves to support and seal against a cylindrical sleeve during the liner-forming process. As explained later, annular bead portion 106*a* advantageously seals against the finish of the bottle to fluidly seal any irregularities, such as bumps or unevenness in the finish. Retainer 116 is inclined and converges radially inward away from top 110. If desired, retainer 116 may be reinforced, as illustrated in FIGS. 9 and 10 and hereinafter described.

In the illustrative embodiment, the exterior surface of skirt 112 has circumferentially spaced vertical finger-gripping ribs 120 to facilitate gripping of the cap. The vertical ribs terminate in an outer rim 124 spaced below top 110. An annular shoulder 126 defines the end of skirt 112.

In order to indicate whether the closure 100 has been opened after the closure 100 has been inserted and screwed onto container 102, a heat-deformable detachable pilfer-band or tamper-proof band 128 is provided at the end of the skirt by a plurality of frangible members or bridges 130. Preferably, pilfer-hand 128 is heat-shrinkable. When formed, pilfer-band 128 is biased radially inward from skirt 112 to provide a frusto-conical band having a minimum inside diameter that is less than the inside diameter of the skirt. The band is subsequently stretched, expanded and lifted to provide a circumferential or cylindrical portion having an inside diameter approximately equal to the inside diameter of the skirt 112 to enable the cap 104 to be inserted onto the container 102. The cylindrical band has a resilient memory and when reheated will assume its original frusto-conical shape.

After the composite plastic closure 100 has been inserted and screwed onto the container 102, pilfer-band 128 is heated to shrink about and engage the bottle neck. When closure 100 is unscrewed to open the bottle 102, pilfer-band 128 will fracture or break in selected areas. In the preferred embodiment, some of the frangible bridges 130 are thicker than others so that when the closure 100 is removed from the bottle, the pilfer-band will tear into one or more pieces and still be attached to the closure 100 by the thicker bridges. Pilfer-band 128 may be formed with one or more areas of reduced strength such as shown in U.S. Pat. Nos. 4,033,472, to Aichinger, and 4,156,490 to Peraboni, so that the pilfer-band fractures during removal of closure 100 from container 102. In some circumstances it may be desirable that the bridges 130 all have the same thickness and be only horizontally scored so that the pilfer-band 128 will remain on the bottle 102 when the closure 100 is removed.

In order to provide a secure mechanical interconnection between the liner 106 and the cap 104, liner retention is provided by one of a number of arrangements. Experience has shown that the engagement and confinement of bead portion 106*a* of the liner 106 by retainer 116 of cap 104 provides significant retention of the liner within the cup. Additional liner retention may be provided by utilizing an adhesive, as is known in the art, or by providing a liner 106 of material which is fusible with the material of which the cap 104 is made. Carefully controlled heating during the liner-forming process to plastic deformation temperatures acts to fuse the liner 106 to the cup 104 thus further enhancing the retention of the liner within the cap. However, because of the deformable nature of the thermoplastic of which cap 104 is fabricated when subjected to elevated temperatures for fusing the liner 106, manufacture of a composite closure in this fashion mandates precise temperature control, which may be subject to problems during high speed closure formation. To this end, the illustrative embodiment of the present invention discloses a cap which has a plurality of liner-engaging pedestals 132 that interlockingly engage liner 106. Pedestals 132 extend vertically from the underside 110*b* of cap top 110 to a position above the cap's annular lip 116. As shown in FIGS. 2–5, the pedestals 132 are spaced apart from each other in a grid-like array or matrix in longitudinal parallel rows and lateral parallel rows to define a plurality of liner-receiving passageways, channels or spaces 134 therebetween to receive the liner-forming plastic 106. In the illustrative embodiment, pedestals 132 are substantially uniformly distributed across the underside 110*b* of cap top 110, but it will be appreciated that other arrangements of pedestals could be provided, and the number of individual pedestals varied depending upon the liner holding strength desired. For example, a plurality of pedestals 132 could be disposed in circumferentially spaced relation extending integrally from underside 110*b* so that a ring of pedestals 132 is provided. Liner-receiving spaces 134 and pedestals 132 are circumferentially bounded and surrounded by skirt 112 (FIG. 1).

Each pedestal 132 (FIGS. 3–5) is formed with a generally upright, vertical body 136 extending in the upright (axial) direction. Pedestal-body 136 has a free end or head 138 that is spaced away from the top 110 of cap 104. In the illustrative embodiment, pedestal-body 136 has a generally square cross-section.

In the process of forming the pedestals 132, the free end 136 (FIGS. 3–5) of pedestal-body 138 is upset, such as by compression and/or heating, to form a mushroom-shaped head with an overhang 140 that extends outwardly of the body 138 in a direction generally transverse to the upright direction. Overhangs 140 provide a mechanical interlock between pedestals 132 and liner 106. The holding strength of the pedestals and the tear strength of the mechanical connection between the liner 106 and pedestals 132, is proportional to the diameter and extent of the overhang 140 of pedestals 122, the number of pedestals 132 and the spacing 134 between pedestals. For a given number of pedestals, increasing the diameter and extent of the overhang 140 of the mushroom-shaped head will increase the tear strength (peel strength) of the closure. Therefore, by varying the amount of the overhang, the peel strength of the pedestals can be varied to a desired amount, such as between two and six pounds. This versatility is important because it permits the liner 106 to be detached or stripped from the pedestals 132 with a minimum amount of effort at a later time. The maximum bond and holding strength between the pedestals 132 and liner 106 occurs when the overhangs 140 of the pedestals contact each other.

Referring now to the plastic liner 106, the liner 106 has a centrally disposed circular disc-shaped portion or membrane **106*b* (FIG. 1) that extends across and is connected to and circumscribed by an annular sealing bead 106*a*. Disc portion 106*b* engages the underside 110*a* of cap-top 110 and extends to a position beneath the mushroom-shaped heads 138 to completely cover and overlie pedestals 132. Annular bead 106*a* is confined in the channel between top 110 and retainer 116, and is preferably substantially thicker than disc portion 106*b* of the liner 106. In the illustrative embodiment, the outer face of bead 106*a* has a rounded lower portion 142 (FIG. 6) that is shaped complementary to the internal rounded corner that connects the top 110 to skirt 112, and has an outer upper frusto-conical portion 144 that is inclined and converges radially inward away from top 110, and engages retainer 116. The inner face of bead 106*a* has a vertical lower portion or shoulder 146 and an upper frusto-conical sealing portion 148 that is inclined and diverges radially outward from shoulder 146. Upper sealing portion 148 resiliently seals and seats against the finish and rim of the bottle to abut against and fluidly seal any irregularities, such as bumps or unevenness, in the finish. It will be noted that a significant portion of annular bead 106*a* is disposed between retainer 116 and top wall 110. This is important since sealing of the container to which closure 100 is fitted takes place along sealing portion 148, and secure retention of bead portion 106*a* by retainer 116 helps to prevent sealing engagement with the container from dislodging or "folding-over" bead portion 106*a***.

When certain types of thermoplastic liners 106 are used, such as EVA liners, the liner 106 is thermally fused and bonded to pedestals 132 (FIG. 5) as it is compression molded and heated during the liner-forming process. This provides a thermo-connection in addition to the mechanical interlock provided by the mushroom-shaped pedestals 132 (FIG. 5). For other materials, such as PVC, the liner may not be fused to the pedestals when it is compression molded and heated, but it is still securely mechanically held by the mushroom-shaped pedestals 132.

Advantageously, the resultant secure mechanical interconnection between cap 104 and liner 106 attributable to the holding strength of the mushroom-shaped pedestals 132 permits the liner to be molded without heating the cap, or at least without heating the non-pedestal portions of the cap, to its melting and plastic deformation temperature, thereby minimizing distortion of the cap when the liner is formed.

It will be appreciated that pedestals having heads or overhangs with other shapes could also be used to provide a mechanical interlock with the liner in accordance with principles of the present invention.

The composite plastic closure 150 shown in FIG. 6 is identical to the composite closure 100 shown in FIG. 1, except that the pedestals 152 are in the form of fusible pedestals and do not have an overhang (shown schematically in FIG. 6. Each of the pedestals 152 (FIG. 7) has a generally planar or flat end 154 with a circular edge 156 that defines at least part of a fusible heat concentration zone, that becomes thermally fused to liner 106 (FIG. 6) when liner 106 is compression molded and heated in cap 104 during the liner-forming process. The thermal bond between liner 106 and pedestals 152 provide a solid thermal interconnection between liner 106 and cap 104. Desirably, the shape and arrangement of the fusible pedestals 152 are such as to permit the pedestals to be heated to their melting and plastic deformation temperature for fusion with the liner 106, while the other portions of the cap 104 are kept cooler, thereby minimizing distortion of the cap when the liner is formed and facilitating high speed closure manufacture.

FIG. 8 illustrates a cap top underside **110*b* of a composite closure similar to closure 150 shown in FIGS. 6 and 7, except that fusible pedestals 162 are provided which are pyramid-shaped with the bases 164 of the pyramids 162 in each lateral row 166 contiguous. The apex or peak 168 of each pyramid 162 and the portions immediately adjacent thereto provides a fusible heat concentration zone 170 that becomes thermally fused to the molten liner-forming plastic as the liner is compression molded and heated in the cap during the liner-forming process. The fusible pyramid-shaped pedestals 162 also permit the pedestals to be heated to their melting and plastic deformation temperature for fusion to the liner 106, while the other portions of the cap are kept cooler so as to minimize distortion of the cap 104 when the liner is formed. Because of the shape, arrangement and high heat transfer capabilities of the pyramid-shaped pedestals 162, it is believed that the cap with pyramid-shaped pedestals 162 can be kept even cooler than a cap with cylindrical pedestals 152**, when the liner is formed.

It was found that pyramids with a radius at the apex of approximately 0.0002 inch had about the same adhesion (thermal connection strength) with a liner as 0.013 inch diameter cylindrical pedestals that were formed with a 50 mesh stainless steel screen. Prior art closures provided only about one-fifth the adhesion (holding strength) of the pyramids and cylinders.

It will be appreciated that fusible pedestals having various distributions could also be used to provide the desired liner retention characteristics.

A modification of the composite plastic closure 150 illustrated in FIG. 6 is shown in FIGS. 9 and 10. The closure 150 shown in these figures includes a plurality of circumferentially spaced, integrally formed gussets 117 extending between the retainer 116 and skirt 112 of the cap 104. Gussets 117 rigidify and reinforce the retainer 116 to enhance its retention of annular bead portion 106 of liner 106 so that proper sealing of the container 102 by the closure is effected. It is preferred that gussets 117 do not extend all the way to the inwardly most edge of the retainer 116, but are spaced from this edge. This permits retainer 116 to support and seal against a cylindrical sleeve during the liner-forming process without inference with the gussets 117. Experience has shown that spacing of the gussets 117 approximately 10 degrees apart about the circumference of the closure 150 provides the desired reinforcement of retainer 116, but other spacing intervals may also be used.

It should be noted that although gussets 117 have been shown as a modification of closure 150 illustrated in FIG. 6 (which may include either cylindrical pedestals 152 or pyramid-shaped pedestals 162), reinforcing gussets 117 may also be provided as described for composite closure 110 shown in FIG. 1 which includes pedestals 132 having overhangs 140 for mechanically interlocking the liner 106 to the cap 104.

It will be appreciated by those skilled in the art, that fusible pedestals having other configurations can be used in accordance with principles of the present invention.

Although embodiments of the invention have been shown and described, it is to be understood that various modifications and substitutions can be made by those skilled in the art without departing from the novel spirit and scope of this invention.

What is claimed:

1. A composite closure for a container, such as a bottle, having a neck and a finish about the mouth of said container, comprising:

a plastic cap formed of spirally orientated molecules for enhanced strength, said plastic cap having a top wall portion with an underside, an internally threaded annular skirt depending from said top wall portion and a heat-shrinkable pilfer band detachably connected to said skirt, said top wall portion having a plurality of liner-engaging pedestals extending from its underside in generally normal relation thereto in an area bounded by said skirt, each of said pedestals having a free end spaced from said top wall portion, said free ends being spaced from each other to define liner-receiving spaces therebetween, said pilfer band having an internal diameter at least as large as the internal diameter of said skirt for insertion onto said container; and a plastic liner disposed in said cap and connected to and retained within said cap by said pedestals, said plastic liner having a resilient annular sealing bead adjacent said skirt for resiliently sealing against the finish of said container and a centrally disposed disc-shaped portion extending substantially across and connected to said annular sealing bead, said centrally disposed disc-shaped portion extending from a position adjacent said top wall portion to a position spaced from the free ends of said pedestals in a direction generally away from said top wall portion, said disc-shaped portion providing a generally planar surface for substantially covering the mouth of said container;

wherein said cap has an internal annular lip extending inwardly of said skirt providing a retainer for engaging and retaining said plastic liner and for providing a seal during the liner-forming process.

2. A composite closure in accordance with claim 1, wherein said pedestals are spaced from each other in a grid-like array of longitudinal and lateral rows of substantially parallel pedestals.

3. A composite closure in accordance with claim 2 wherein each of said pedestals has a generally upright body extending in a generally upright direction and has portions extending outwardly of said body adjacent said free end in a direction generally transverse to said upright direction for providing a head having an overhang to interlockingly engage said plastic liner.

4. A composite closure in accordance with claim 3 wherein said body has a generally square cross-section and said head is mushroom-shaped.

5. A composite closure in accordance with claim 2 wherein each of said pedestals is cylindrical and has a circular edge about its free end for providing a fusible heat concentration zone that is thermally fused to said liner.

6. A composite closure in accordance with claim 2 wherein each of said pedestals is pyramid-shaped with a base and an apex, said apex providing a fusible heat concentration zone that is thermally fused to said liner.

7. A composite closure in accordance with claim 6 wherein said bases of said pyramid-shaped pedestals in each lateral row are generally contiguous to each other.

8. A composite closure for a container, such as a bottle, comprising:

a plastic cap having a top wall portion with a plurality of liner-engaging pedestals extending therefrom, said liner-engaging pedestals having portions spaced from each other to define liner-receiving spaces therebetween, each of said pedestals having a free end spaced from said top wall portion, and said plastic cap having an annular skirt depending from said top wall portion and bounding said liner-engaging pedestals and said liner-receiving spaces, and a liner-retaining lip spaced from said top wall portion; and a substantially fluid-impervious plastic liner disposed in said liner-receiving spaces and connected to said pedestals for engaging and fluidly sealing said container, said plastic liner having an annular sealing portion adjacent said skirt engaged by said liner-retaining lip, and a centrally disposed portion connected to said annular sealing portion, said centrally disposed portion extending from a position adjacent said top wall portion to a position spaced from the free ends of said pedestals in a direction generally away from said top wall portion for overlying said pedestals;

wherein said pedestals include fusible pedestals having a heat concentration zone that is thermally fused to said plastic liner.

9. A composite closure in accordance with claim 8 wherein each of said fusible pedestals has a cylindrical configuration with a circular edge that defines at least part of said heat concentration zone.

10. A composite closure in accordance with claim 8 wherein each of said fusible pedestals has an apex that defines at least part of said heat concentration zone.

11. A composite closure in accordance with claim 10 wherein each of said fusible pedestals are pyramid-shaped.

12. A composite closure in accordance with claim 8, and an integral heat deformable pilfer band detachably connected to said skirt.

13. A composite closure in accordance with claim 12, wherein said heat deformable pilfer band comprises a heat shrinkable pilfer band.

14. A composite closure for a container, such as a bottle, comprising:

a plastic cap having a top wall portion with a plurality of liner-engaging pedestals extending therefrom in generally normal relation to said top wall portion, said liner-engaging pedestals having portions spaced from each other to define liner-receiving spaces therebetween, each of said pedestals having a free end spaced from said top wall portion, and said plastic cap having an annular skirt depending from said top wall portion and bounding said liner-engaging pedestals and said liner-receiving spaces, and an annular liner-retaining lip; and a substantially fluid-impervious plastic liner disposed in said liner-receiving spaces and connected to said pedestals for engaging and fluidly sealing said container, said plastic liner having an annular sealing portion adjacent said skirt and said liner-retaining lip and a centrally disposed portion connected to said annular sealing portion, said centrally disposed portion extending from a position adjacent said top wall portion to a position spaced from the free ends of said pedestals in a direction generally away from said top wall portion for overlying said pedestals;

wherein at least some of said pedestals have an overhang for interlockingly engaging said liner.

15. A composite closure in accordance with claim 14 wherein said overhang is mushroom-shaped.

16. A composite closure in accordance with claim 14, wherein said plastic cap includes means for reinforcing said liner-retaining lip.

17. A composite closure for a container comprising:

a plastic cap having a top wall portion and an annular skirt, said top wall portion including a plurality of liner-engaging pedestals extending therefrom, said pedestals having portions spaced from each other to define liner-receiving spaces therebetween, said plastic cap having an annular liner-retaining lip in spaced relation to said pedestals, and a substantially fluid-impervious plastic liner disposed in said liner-receiving spaces and including an annular bead portion adjacent to said liner-retaining lip, said liner being connected to said pedestals for engaging and fluidly sealing said container.

18. A composite closure in accordance with claim 17, wherein at least some of said pedestals include overhanging portions for interlocking said liner with said cap.

19. A composite closure in accordance with claim 17, wherein said liner is thermally fused to at least some of said pedestals.

20. A composite closure in accordance with claim 17, wherein said liner-engaging pedestals are disposed in a grid-like array for enhancing retention of said liner within said cap.

21. A composite closure in accordance with claim 17, wherein said plastic cap includes a plurality of circumferentially spaced gussets extending between said liner-retaining lip and said annular skirt for reinforcing said lip.

22. A composite closure in accordance with claim 17, and a heat deformable pilfer band detachably connected to said skirt.

23. A composite closure for a container comprising:

a plastic cap including a top wall portion, an annular skirt portion, and an inwardly extending annular liner-retaining lip spaced from said top wall portion and defining a recess therewith, and a substantially fluid-impervious plastic liner formed in said cap disposed adjacent said top wall portion including a centrally disposed portion, and an annular bead portion adapted to sealingly engage said container, said annular bead portion engaging and retained by said annular lip, at least a portion of said annular bead portion being disposed within and substantially filling said recess.

24. A composite closure for a container comprising:

a plastic cap including a top wall portion, an annular skirt portion, and an inwardly extending annular liner-retaining lip spaced from said top wall portion and defining a recess therewith, and a substantially fluid-impervious plastic liner disposed adjacent said top wall portion including a centrally disposed portion, and an annular bead portion adapted to sealingly engage said container, said annular bead portion engaging and retained by said annular lip, at least a portion of said annular bead portion being disposed within said recess; and liner-retention means for connecting said plastic liner with said top wall portion.

25. A composite closure in accordance with claim 24, wherein said liner-retention means comprise fused portions of said centrally disposed portion of said liner and said top wall portion of said cap.

26. A composite closure in accordance with claim 24, wherein said liner-retention means comprise a plurality of liner-engaging pedestals integral with said top wall portion.

27. A composite closure in accordance with claim 26, wherein said plastic liner is thermally fused to portions of said pedestals.

28. A composite closure in accordance with claim 26, wherein said plastic liner is mechanically connected to said pedestals.

29. A composite closure in accordance with claim 24, wherein said plastic cap includes means for reinforcing said liner-retaining lip comprising a plurality of circumferentially spaced gussets extending between said liner-retaining lip and said annular skirt portion, said annular sealing portion is substantially thicker than said centrally disposed portion, and includes a generally frusto-conical sealing surface adapted to sealingly engage said container.

30. A composite closure in accordance with claim 24, said plastic cap including a plurality of circumferentially spaced gussets extending between said liner-retaining lip and said annular skirt portion.

31. A composite closure for a container comprising:

a plastic cap including a top wall portion, an annular skirt portion, a heat deformable pilfer-band detachably connected to said skirt portion, and an inwardly extending liner retaining lip defining an annular recess with said top wall portion, and a substantially fluid-impervious plastic liner disposed adjacent said top wall portion including a centrally disposed portion, and an annular bead portion engaging and retained by said annular lip and substantially filling said annular recess, said closure including liner-retainer means integral with said top wall portion for retaining said liner within said plastic cap.

32. A composite closure in accordance with claim 31, wherein said liner-retention means comprises fusible portions of said top wall portion fused to said plastic liner.

33. A composite closure in accordance with claim 32, wherein said top wall portion includes a plurality of integral pedestals, at least some of said pedestals defining heat concentration zones which include said fusible portions.

34. A composite closure in accordance with claim 31, wherein said top wall portion include a plurality of integral pedestals interlockingly engaging said plastic liner.

35. A composite closure for a container, such as a bottle, having a neck and a finish about the mouth of said container, comprising:

a plastic cap having a top wall portion with an underside, an internally threaded annular skirt depending from said top wall portion and a heat-shrinkable pilfer band detachably connected to said skirt, said top wall portion having a plurality of liner-engaging pedestals extending from its underside in an area bounded by said skirt, each of said pedestals having a free end spaced from said top wall portion, said free ends being spaced from each other to define liner-receiving spaces therebetween; and a plastic liner disposed in said liner-receiving spaces and connected to said pedestals, said plastic liner having a resilient annular sealing bead adjacent said skirt for resiliently sealing against the finish of said container and a centrally disposed disc-shaped portion extending substantially across and connected to said annular sealing bead, said centrally disposed disc-shaped portion extending from a position adjacent said top wall portion to a position spaced from the free ends of said pedestals in a direction generally away from said top wall portion, said disc-shaped portion providing a generally planar surface overlying said pedestals for substantially covering the mouth of said container;

said cap including an internal annular lip extending integrally inwardly from said skirt spaced from said top wall and providing a retainer for retaining said annular sealing bead during the liner-forming process.

36. A composite closure in accordance with claim 35 wherein said pedestals are spaced from each other in a grid-like array of longitudinal and lateral rows of pedestals.

37. A composite closure in accordance with claim 35 wherein each of said pedestals has a generally mushroom-shaped head.

38. A composite closure in accordance with claim 35 wherein each of said pedestals is thermally fused to said liner.

39. A composite closure for a container, such as a bottle, comprising:

a plastic cap having a top wall portion with a plurality of liner-engaging pedestals extending therefrom, said liner-engaging pedestals having portions spaced from each other to define liner-receiving spaces therebetween, each of said pedestals having a free end spaced from said top wall portion, and said plastic cap having an annular skirt depending from said top wall portion and bounding said liner-engaging pedestals and said liner-receiving spaces, and an annular liner-retaining lip; and a substantially fluid-impervious plastic liner disposed in said liner-receiving spaces and connected to said pedestals for engaging and fluidly sealing said container, said plastic liner having an annular sealing portion adjacent said skirt and said liner-retaining lip and a centrally disposed portion connected to said annular sealing portion, said centrally disposed portion extending from a position adjacent said top wall portion to a position spaced from the free ends of said pedestals in a direction generally away from said top wall portion for overlying said pedestals;

wherein each of said pedestals has a generally upright body extending in a generally upright direction and has at least one portion extending outwardly of said body adjacent said free end in a direction generally transverse to said upright direction for providing an overhang to interlockingly engage said plastic liner, said plastic cap including means for reinforcing said liner-retaining lip comprising a plurality of circumferentially spaced integral gussets extending between said liner-retaining lip and said skirt.

40. A composite closure in accordance with claim 39 wherein said overhang is mushroom-shaped.

41. A composite closure for a container, such as a bottle, comprising:

a plastic cap having a top wall portion with a plurality of liner-engaging pedestals extending therefrom, said liner-engaging pedestals having portions spaced from each other to define liner-receiving spaces therebetween, each of said pedestals having a free end spaced from said top wall portion, and said plastic cap having an annular skirt depending from said top wall portion and bounding said liner-engaging pedestals and said liner-receiving spaces, and an annular liner-retaining lip; and a substantially fluid-impervious plastic liner disposed in said liner-receiving spaces and connected to said pedestals for engaging and fluidly sealing said container, said plastic liner having an annular sealing portion adjacent said skirt and said liner-retaining lip and a centrally disposed portion connected to said annular sealing portion, said centrally disposed portion extending from a position adjacent said top wall portion to a position spaced from the free ends of said pedestals in a direction generally away from said top wall portion for overlying said pedestals, wherein at least some of said pedestals have an overhang for interlockingly engaging said liner;

said plastic cap including means for reinforcing said liner-retaining lip comprising a plurality of circumferentially spaced integral gussets extending between said liner retaining lip and said skirt.

42. A composite closure in accordance with claim 41, wherein said annular sealing portion is substantially thicker than said centrally disposed portion and includes a generally frusto-conical sealing surface adapted to sealingly engage said container.

43. A composite closure in accordance with claims 39 or 41, wherein said annular sealing portion is substantially thicker than said centrally disposed portion and includes a generally frusto-conical sealing surface adapted to sealingly engage said container.

44. A composite closure for a container, such as a bottle, comprising:

a plastic cap having a top wall portion with a plurality of liner-engaging pedestals extending therefrom, said liner-engaging pedestals having portions spaced from each other to define liner-receiving spaces therebetween, each of said pedestals having a free end spaced from said top wall portion, and said plastic cap having an annular skirt depending from said top wall portion and bounding said liner-engaging pedestals and said liner-receiving spaces; and a substantially fluid-impervious plastic liner disposed in said liner-receiving spaces and connected to said pedestals for engaging and fluidly sealing said container, said plastic liner having an annular sealing portion adjacent said skirt and a centrally disposed portion connected to said annular sealing portion, said centrally disposed portion extending from a position adjacent said top wall portion to a position spaced from the free ends of said pedestals in a direction generally away from said top wall portion for overlying said pedestals, said pedestals including fusible pedestals having a heat concentration zone that is thermally fused to said plastic liner;

said plastic cap including an annular, inwardly extending liner-retaining lip engaging said annular sealing portion of said plastic liner, said plastic cap including a plurality of circumferentially spaced gussets extending between said liner-retaining lip and said annular skirt.

45. A composite closure in accordance with claim 44, wherein each of said fusible pedestals has a cylindrical configuration with a circular edge that defines at least part of said heat concentration zone.

46. A composite closure in accordance with claim 44, wherein each of said fusible pedestals has an apex that defines at least part of said heat concentration zone.

47. A composite closure for a container comprising:

a plastic cap having a top wall portion and an annular skirt, said top wall portion including a plurality of liner-engaging pedestals extending therefrom, said pedestals having portions spaced from each other to define liner-receiving spaces therebetween, said plastic cap having an annular liner-retaining lip in spaced relation to said pedestals, and a substantially fluid-impervious plastic liner disposed in said liner-receiving spaces and including an annular bead portion adjacent to said liner-retaining lip, said liner being connected to said pedestals for engaging and fluidly sealing said container, said plastic cap including a plurality of circumferentially spaced gussets extending between said liner-retaining lip and said annular skirt for reinforcing said lip.

48. A composite closure in accordance with claim 47, wherein at least some of said pedestals include overhanging portions for interlocking said liner with said cap.

49. A composite closure in accordance with claim 47, wherein said liner is thermally fused to at least some of said pedestals.

50. A composite closure in accordance with claim 47, wherein said liner-engaging pedestals are disposed in a grid-like array for enhancing retention of said liner within said cap.

51. A composite closure in accordance with claim 47, and a heat deformable pilfer band detachably connected to said skirt.

52. A composite closure for a container comprising:

a plastic cap including a top wall portion, an annular skirt portion, and an inwardly extending annular liner-retaining lip, and a substantially fluid-impervious plastic liner disposed adjacent said top wall portion including a centrally disposed portion, and an annular bead portion engaging and retained by said annular lip, said plastic cap including means for reinforcing said liner-retaining lip comprising a plurality of circumferentially spaced gussets extending between said liner-retaining lip and said annular skirt portion, said annular sealing portion being substantially thicker than said centrally disposed portion, and including a generally frusto-conical sealing surface adapted to sealingly engage said container.

53. A composite closure in accordance with claim 52, and a plurality of liner-engaging pedestals integral with said top wall portion for retaining said plastic liner within said cap.

54. A composite closure in accordance with claim 53, wherein at least some of said pedestals include portions thermally fused with said plastic liner.

55. A composite closure in accordance with claim 53, wherein said plastic liner is mechanically connected to said pedestals.

56. A composite closure in accordance with claim 55, wherein at least some of said pedestals are generally mushroom-shaped and include overhanging portions for mechanically connecting said liner to said pedestals.

57. A composite closure in accordance with claim 53, and a heat deformable pilfer band detachably connected to said skirt.

58. A composite closure for a container, such as a bottle, comprising:

a plastic cap having a top wall portion with a plurality of liner-engaging pedestals extending therefrom, said liner-engaging pedestals having portions spaced from each other to define liner-receiving spaces therebetween, each of said pedestals having a free end spaced from said top wall portion, and said plastic cap having an annular skirt depending from said top wall portion and bounding said liner-engaging pedestals and said liner-receiving spaces; and a substantially fluid-impervious plastic liner disposed in said liner-receiving spaces and connected to said pedestals for engaging and fluidly sealing said container, said plastic liner having an annular sealing portion adjacent said skirt and a centrally disposed portion connected to said annular sealing portion, said centrally disposed portion extending from a position adjacent said top wall portion to a position spaced from the free ends of said pedestals in a direction generally away from said top wall portion for overlying said pedestals, said pedestals including at least some fusible pedestals that are pyramid-shaped and have an apex that defines at least part of a heat concentration zone that is thermally fused to said liner, said plastic cap including an annular, inwardly extending liner-retaining lip engaging said annular sealing portion of said plastic liner, and a plurality of circumferentially spaced gussets extending between said liner-retaining lip and said annular skirt.

59. A composite closure for a container, comprising:

a plastic cap having a top wall portion and an annular skirt portion depending therefrom, said plastic cap including an inwardly extending annular lip spaced from said top wall portion and defining a recess with said top wall portion, and a plurality of liner-engaging pedestals extending integrally from said top wall portion, and a plastic liner disposed adjacent said top wall portion and retained within said cap by said pedestals, said plastic liner including an annular sealing bead portion substantially filling said recess and adapted to sealingly engage said container.

60. A composite closure in accordance with claim 59, wherein at least some of said pedestals are upset to include overhanging portions for interlockingly engaging said plastic liner.

61. A composite closure in accordance with claim 60, wherein said pedestals are disposed in a grid-like array across said top wall portion.

62. A composite closure in accordance with claim 59, wherein said plastic liner is thermally fused to at least some of said pedestals.

63. A composite closure in accordance with claim 59, and a heat deformable pilfer band detachably connected to said annular skirt.

64. A composite closure for a container, comprising:

a plastic cap having a top wall portion and an annular skirt portion depending therefrom, said plastic cap including an inwardly extending liner-retaining lip spaced from said top wall portion and having a non-horizontal surface facing said top wall portion, said lip being formed before said cap is lined and a compression molded plastic liner formed in said cap adaped to sealingly engage said container and being retained within said plastic cap by said liner-retaining lip.

65. A composite closure for a container, comprising:

a plastic cap having a top wall portion and an annular skirt portion depending therefrom, said plastic cap including an inwardly extending liner-retaining lip spaced from said top wall portion and having a non-horizontal surface facing said top wall portion, and a plastic liner adapted to sealingly engage said container retained within said plastic cap by said liner-retaining lip, said plastic cap including a plurality of liner-engaging pedestals integral with said top wall portion.

66. A composite closure for a container, comprising:

a compression molded plastic cap having a top wall portion, an annular skirt portion depending from said top wall portion and including an internal thread formation, and an inwardly extending annular lip spaced from said top wall portion and defining a recess therewith, said annular lip being formed before said cap is lined and having an inside diameter less than the inside diameter of said thread formation; and a compression molded plastic liner retained within said cap by said annular lip, said annular lip retaining said plastic liner during formation of said plastic liner in said cap.

67. A composite closure in accordance with claim 66, and a plurality of liner-engaging pedestals extending integrally from said top wall portion.

68. A composite closure for a container comprising:

a plastic cap including a top wall portion, an annular skirt portion having an internal thread formation, a pilfer-band detachably connected to said skirt portion by spaced frangible bridge means, and an inwardly extending annular liner-retaining lip defining an annular recess with said top wall portion, and a substantially fluid-impervious plastic liner disposed adjacent said top wall portion including a centrally disposed portion, and an annular bead portion engaging and retained by said annular lip and substantially filling said annular recess, said cap including a plurality of liner-engaging projections integral with said top wall portion for retaining said liner within said plastic cap.

69. A composite closure for a container comprising:

a compression molded plastic cap including a top wall portion, an annular skirt portion having an internal thread formation, at least one liner-engaging projection extending integrally from said top wall portion, and an inwardly extending annular liner-retaining lip spaced from said top wall portion and defining a recess therewith; and a substantially fluid-impervious compression molded plastic liner disposed adjacent said top wall portion in engagement with said liner-engaging projection, and including an annular bead portion adapted to sealingly engage said container, said annular bead portion being engaged and retained by said annular lip, said annular bead portion being at least partially disposed within said annular recess.

70. A composite closure in accordance with claim 69, including a plurality of liner-engaging projections.

71. A composite closure in accordance with claim 70, wherein at least some of said projections are thermally fused to said plastic liner.

72. A composite closure in accordance with claim 70, wherein at least some of said projections mechanically retain said plastic liner within said cap.

73. A composite closure in accordance with claim 69, 70, 71, or 72, and a pilfer-band connected to said skirt portion by a plurality of spaced frangible bridge means.

74. A composite closure for a container having a finish, comprising:

a plastic cap including a top wall portion and a depending annular skirt portion having an internal thread formation, and lip means integral with and extending inwardly of said skirt portion, said lip means being spaced from said top wall portion and defining a recess therewith; and a substantially fluid-impervious plastic liner disposed adjacent said top wall portion including a peripheral sealing portion positioned adjacent said skirt portion adapted to sealingly engage the finish of said container, said lip means confining said peripheral sealing portion within said recess to retain said plastic liner within said plastic cap;

said plastic cap including liner-retention means integral with said top wall portion for retaining said plastic liner in position within said plastic cap.

* * * * *